US007600611B2

(12) United States Patent
Woodhams et al.

(10) Patent No.: US 7,600,611 B2
(45) Date of Patent: Oct. 13, 2009

(54) STAIRLIFTS

(75) Inventors: Max D. Woodhams, Hants (GB); Konrad J Higgins, Hampshire (GB)

(73) Assignee: Stannah Stairlifts Limited, Andover, Hampshire (GB)

( * ) Notice: Subject to any disclaimer, the term of this patent is extended or adjusted under 35 U.S.C. 154(b) by 0 days.

(21) Appl. No.: 10/590,452

(22) PCT Filed: Mar. 2, 2005

(86) PCT No.: PCT/GB2005/000642

§ 371 (c)(1),
(2), (4) Date: Apr. 24, 2007

(87) PCT Pub. No.: WO2005/085114

PCT Pub. Date: Sep. 15, 2005

(65) Prior Publication Data

US 2007/0272488 A1 Nov. 29, 2007

(30) Foreign Application Priority Data

Mar. 2, 2004 (GB) ..... 0404643.9

(51) Int. Cl.
*B66B 9/08* (2006.01)

(52) U.S. Cl. ..... 187/201; 187/200

(58) Field of Classification Search ..... 187/201, 187/200, 202
See application file for complete search history.

(56) References Cited

U.S. PATENT DOCUMENTS 1,237,627 A * 8/1917 Forbes ..... 187/201

FOREIGN PATENT DOCUMENTS

| | | | |
|---|---|---|---|
| EP | 040858 | | 10/1991 |
| EP | 0 738 232 | | 5/1998 |
| GB | 2360994 | | 10/2001 |
| JP | 03098982 A | * | 4/1991 |
| JP | 05116866 A | * | 5/1993 |
| JP | 2002154767 | | 5/2002 |
| NL | 1020911 | | 6/2002 |
| WO | WO 97/26207 | | 7/1997 |
| WO | WO 02/064481 | | 8/2002 |
| WO | WO 2004/043845 | | 5/2004 |

* cited by examiner

*Primary Examiner*—John Q. Nguyen
*Assistant Examiner*—Eric Pico
(74) *Attorney, Agent, or Firm*—Nixon & Vanderhye, PC

(57) ABSTRACT

The invention provides a stairlift having a rail which terminates, at its lower end, on or closely adjacent the lower step of a staircase. This rail is combined with a carriage and footrest which allows the footrest to be positioned below the level of the first step. The arrangement obviates the need for a hinge in the rail.

5 Claims, 1 Drawing Sheet

STAIRLIFTS

This application is the U.S. national phase of international application PCT/GB05/00642, filed Mar. 2, 2005, which designated the U.S. and claims priority of GB 0404643.9, filed Mar. 2, 2004, the entire contents of each of which are hereby incorporated by reference.

FIELD OF THE INVENTION

This invention relates to stairlifts.

BACKGROUND TO THE INVENTION

In a significant number of stairlift installations, the lower end of the stairlift rail must overhang, or extend a significant distance beyond and below, the first step of the staircase, to permit the stairlift carriage and footrest to terminate sufficiently closely to the floor, at the base of the staircase, to allow a stairlift user to easily mount, and dismount from, the stairlift. Consequently, if there are one or more doorways positioned adjacent the bottom of the staircase, the lower end of the rail will inevitably obstruct the opening and closing of doors; or otherwise obstruct normal day-to-day activity within the home.

To address this problem, the traditional solution has been to hinge the lower section of rail so that, when the stairlift is not in use, the lower end of the rail may be displaced into a position in which no obstruction is caused. An example of such a hinge is described in published International Patent Application No. WO 97/26207. An alternative arrangement, in which the lower end of the rail is displaced longitudinally with respect to the main rail section, is described in our UK Patent 2 360 994.

Both forms of prior art apparatus, referred to above, are relatively costly to manufacture and implement. They also add bulk and detract, aesthetically, from a stair lift installation. Further, conscious human intervention is typically required to ensure that, when the stairlift is not in operation, the lower rail section is displaced out of its operating position in which it may cause an obstruction.

It is an object of this invention to provide a stairlift installation which will go at least some way in addressing the aforementioned problems; or which will at least provide a novel and useful alternative.

SUMMARY OF THE INVENTION

Accordingly, in a first aspect, the invention comprises a method of providing a stairlift installation on a staircase having a first step up from the floor from which said staircase extends, said stairlift installation having:

a rail having a lower end and an upper end;

a carriage mounted on said rail for movement there-along;

a footrest mounted on said carriage for displacement with said carriage, said method being characterised in that the lower end of said rail is terminated substantially on said first step, and said rail and said carriage are constructed and arranged to ensure that, when said carriage is at its lower most position on said rail, said footrest is positioned below the level of, said first step.

In a second aspect the invention provides a stairlift for use on a staircase having a first step up from the floor from which said staircase extends, said stairlift including:

a rail having a lower end and up upper end;

a carriage mounted on said rail for movement there-along;

a footrest mounted on said carriage for displacement therewith;

said stairlift being characterised in that substantially the lower end of said rail is fixed to said first step, and said rail and said carriage are constructed and arranged such that, when said carriage is at its lower most position on said rail, said footrest is positioned below the level of, said first step.

Preferably said rail has a main section arranged at the angle of said stairway, and a lower section extending from said main section which is angled downwardly with respect to said main section.

Preferably said lower section is substantially vertical.

In a third aspect the invention provides a rail for use in the stairlift installation set forth above, said rail having a lower section and a main section and being characterised in that said lower section is arranged at an angle to said main section.

Preferably said rail is defined by a single longitudinal member.

In a fourth aspect the invention comprises any novel combination of integers disclosed herein capable of addressing a problem known in the stairlift art.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future. The scope of the invention should be limited by the appended claims alone.

BRIEF DESCRIPTION OF THE DRAWINGS

One particular embodiment of the invention will now be described with reference to the accompanying drawings in which.

DETAILED DESCRIPTION OF WORKING EMBODIMENT

Figure 1:
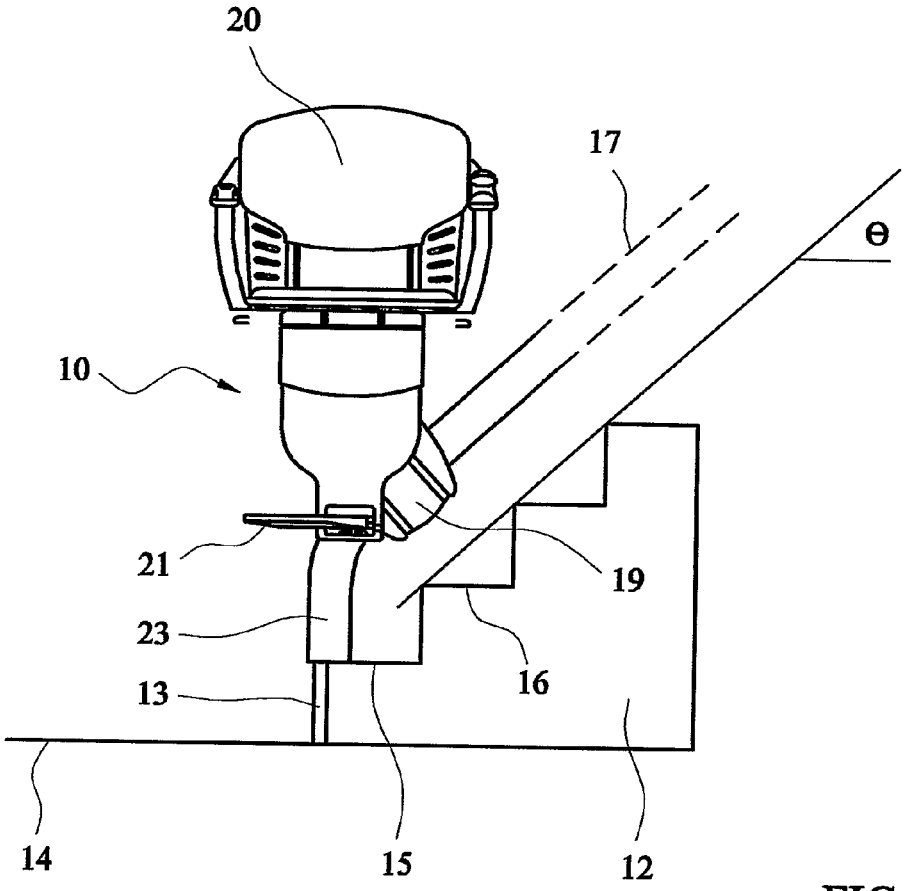
FIG. 1: shows a stairlift installation according to the invention in a first position.

As can be seen in the drawings, according to the invention a stairlift installation 10 is provided for mounting on a staircase, part of the staircase being shown at 12. In the conventional manner staircase 12 extends upwardly from the floor 14 and includes a first step 15 and a second step 16 etc.

Also in the conventional manner, the stairlift 10 includes a rail 17 which extends up the stairway, at angle Ø, substantially parallel to the angle of the line through the edges of the stair treads. The stairlift installation further includes a carriage 19 which is displaceable up and down the rail, a chair 20 which is mounted on the carriage 19 for movement therewith, and a footrest 21 which again moves with the carriage 19.

Figure 2:
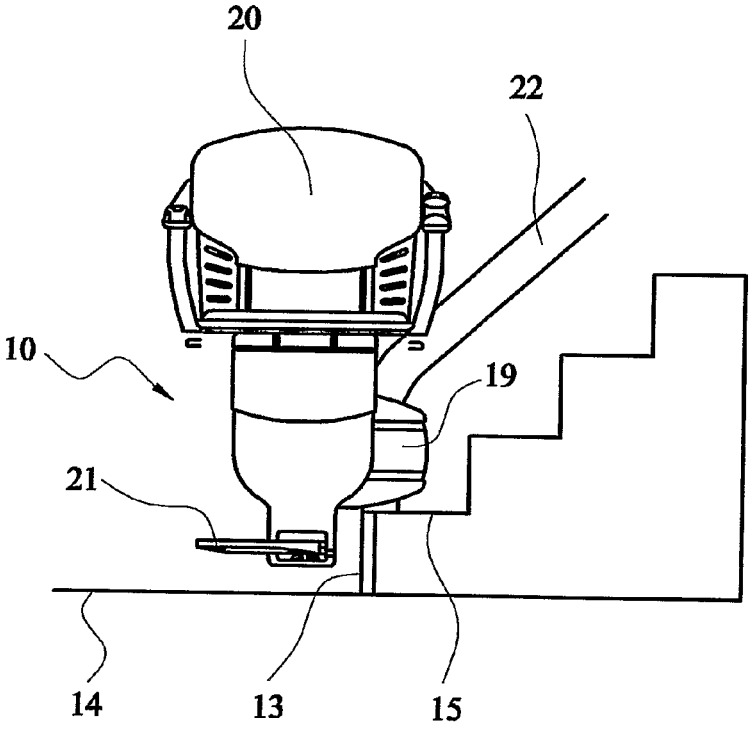
FIG. 2: shows a similar view to FIG. 1 but in a second, lower, position of operation

In accordance with the invention, the lower end of the rail 17 is terminated substantially on the first step 15 of the staircase 12 as opposed to continuing down and engaging the floor 14. Further, the carriage 19 is constructed and arranged so that, when the carriage is at its lower most position on the rail 17, as shown in FIG. 2, the footrest 21 lies below the lower edge of the rail and thus below the level of the first step 15. In this way a stairlift user can easily and safely mount, and dismount from, the chair 20.

In the preferred form of the invention, there will be no overhang of the rail at the bottom of the stairway. However, the invention envisages that part of the rail may pass down to the floor closely adjacent the first riser 13. In practice, no part of the rail should project more than about 100 mm in front of the first step 15. Certainly, all forms of the invention envisage that no part of the carriage should intrude between the rail and the first riser 13.

The rail is preferably of a form described in our pending International Patent Application No. PCT/GB02/00607 or PCT/GB03/004746. The skate arrangement, i.e. the configuration and arrangement of rollers through which the carriage 19 engages with the rail 17, is preferably as described in our pending International Patent Application No. PCT/GB02/00607 or our pending British Patent Application No. 0404647.0. The particular rail, skate and carriage arrangements described provide a compact unit which assists in the realisation of the present invention.

It will be appreciated, from comparing FIGS. 1 and 2, that as the carriage moves from the position shown in FIG. 1, to that shown in FIG. 2, there is a considerable degree of rotation of the chair 20 with respect to the carriage 19, in order to maintain the chair in a level configuration. Such rotation, or maintenance of level, may be effected using the levelling arrangement described in our European Patent 0 738 232.

It will further be appreciated that the realisation of the invention is further assisted by the linear geometry of the rail 17. More particularly, the rail 17 includes a main section 22 which extends, parallel to the staircase, at angle Ø, and a lower section 23 which is angled downwardly from the main section 22. In the particular embodiment shown herein, the lower section 23 of the rail is arranged substantially vertically when the installation is in place. Thus, during its lower section of travel, the stairlift carriage 19 is moving vertically downwards.

At its lower most position, as shown in FIG. 2, the distance from the footrest 21 to the floor 14 can be as low as 50 to 150 mm.

It will thus be appreciated that the present invention provides an extremely effective form of stairlift installation which enables a stairlift user to safely and conveniently mount, and dismount from, the stairlift yet which avoids the need to provide a hinge in the rail in the event that continuation of the rail to the floor 14 would result in an obstruction at the base of the staircase.

To ensure that the carriage and chair are not left unattended for long periods in the position shown in FIG. 2, and thus create an obstruction themselves, electronics within the carriage 19, which control the operation of the stairlift installation, may include a function to sense when the carriage 19 has been left in the lower most position, unoccupied, and automatically operate the motor within carriage 19 to displace the carriage and chair a short way up the rail, for example to the position shown in FIG. 1. Through such a function, a long term obstruction caused by the stairlift is avoided.

The invention claimed is:

1. A method of providing a stairlift installation on a staircase having a first step having a level above a floor from which the staircase extends, comprising:

providing a rail having a main section arranged at the angle of the staircase and a lower section extending from the main section, the lower section curving downwardly from the main section to terminate substantially on the first step;

providing a carriage mounted on the rail for movement along both said main section and said lower section;

providing a footrest mounted on the carriage for displacement with the carriage; and constructing and arranging the rail and the carriage to ensure that, when the carriage is at a lower most position on the lower section of the rail, the footrest is positioned below the first step level.

2. A stairlift for use on a staircase having a first step having a level above a floor from which the staircase extends, the stairlift comprising:

a rail having a main section arranged at the angle of the staircase and a lower section extending from the main section, the lower section curving downwardly from the main section to terminate substantially on the first step;

a carriage mounted on the rail for movement along both said main section and said lower section; and a footrest mounted on the carriage for displacement with the carriage;

the rail and carriage being constructed and arranged such that, when the carriage is at a lower most position on the lower section of the rail, the footrest is positioned below the first step level.

3. The stairlift of claim 2, in which the lower section is substantially vertical.

4. The stairlift of claim 3 in which the rail comprises a single longitudinal member.

5. The stairlift of claim 2, in which the rail comprises a single longitudinal member.

* * * * *